United States Patent [19]

Vanderminden

[11] Patent Number: 4,941,413

[45] Date of Patent: Jul. 17, 1990

[54] TABLE WITH REINFORCED LEG STRUCTURE

[75] Inventor: Robert D. Vanderminden, Granville, N.Y.

[73] Assignee: Telescope Casual Furniture Co., Granville, N.Y.

[21] Appl. No.: 398,637

[22] Filed: Aug. 25, 1989

Related U.S. Application Data

[63] Continuation of Ser. No. 611,635, May 18, 1984.

[51] Int. Cl.[5] ..... A47B 3/06

[52] U.S. Cl. ..... 108/157; 108/156

[58] Field of Search ..... 108/155, 157, 159, 154, 108/161, 79; 248/165; 297/442

[56] References Cited

U.S. PATENT DOCUMENTS

| | | | |
|---|---|---|---|
| 1,953,655 | 4/1934 | Miller | 108/79 |
| 1,997,660 | 4/1935 | Smith | 108/157 |
| 3,032,380 | 5/1962 | Danciart | 108/154 |
| 3,366,079 | 1/1968 | Koranasky et al. | 108/157 |
| 4,324,433 | 4/1982 | Saiger | 108/155 |
| 4,503,780 | 3/1985 | Apissomian | 108/159 |

FOREIGN PATENT DOCUMENTS

| | | | |
|---|---|---|---|
| 1499422 | 9/1967 | France | 108/157 |

*Primary Examiner*—Peter A. Aschenbrenner
*Attorney, Agent, or Firm*—Kenyon & Kenyon

[57] ABSTRACT

The knock-down table is constructed of a base with interfitting leg frames. The frames have radially disposed horizontal supports on which the tabletop is suppported as well as brackets which receive the ends of the supports in a releasable locking manner. The brackets are disposed in opposed relation to prevent accidental rotation of the tabletop on the base.

17 Claims, 4 Drawing Sheets

Fig. 1.
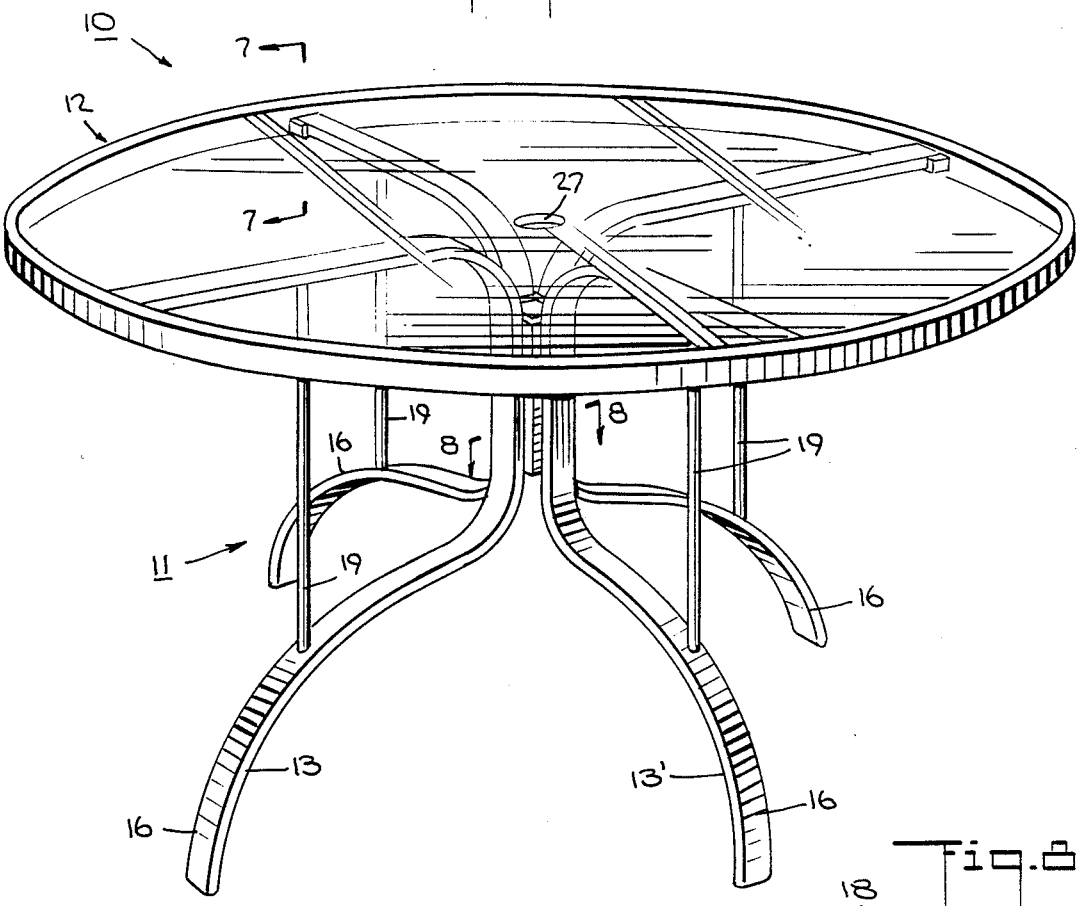
Fig. 8.
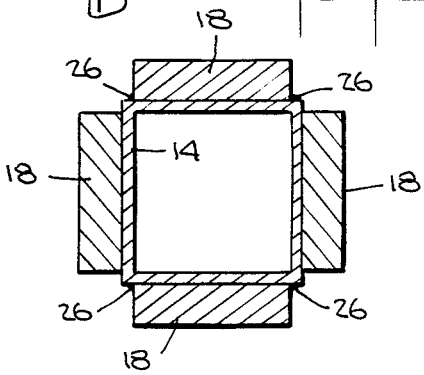
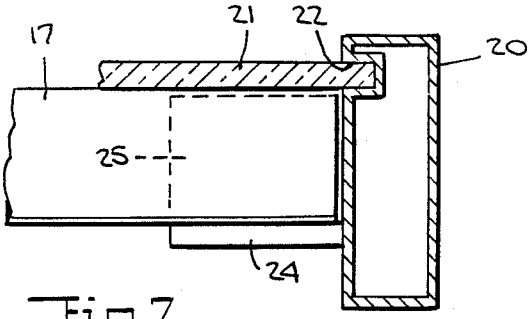
Fig. 7.
Fig. 6.
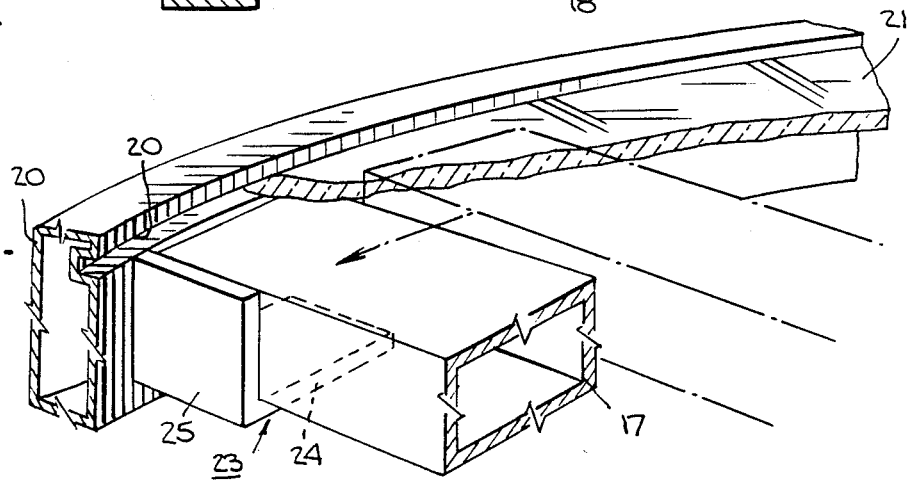

TABLE WITH REINFORCED LEG STRUCTURE

This is a continuation of Ser. No. 611,635, filed May 18, 1984.

This invention relates to a table. More particularly, this invention relates to an outdoor table. Still more particularly, this invention relates to an outdoor table of knock-down construction.

As is known, tables come in various sizes and styles and are used for a variety of purposes. In the case of outdoor tables, for example, for use on patios and at poolside, for example, for eating purposes or for use as umbrella tables, several types of constructions are known.

In some cases, the outdoor tables have been made of unitary construction, for example, with a tabletop rigidly secured to a base. This, however, presents a problem in storing the tables during an out-of-season time. In other cases, the tables have been made of knock-down construction, for example, as described in U.S. Pat. No. 4,315,467, so as to be collapsed into a generally flattened configuration for storage purposes. While such constructions are readily suitable for cocktail tables and other small tables, the construction has not been suitable for large size tables such as umbrella tables. Other types of outdoor tables of knock-down type have also been known, for example as described in U.S. Pat. Nos. 3,032,380 and 4,112,855; however, these constructions are relatively cumbersome and present complex assembly and disassembly procedures. Further, the appearances of such tables can be unattractive.

Other types of outdoor tables have also been known wherein a base composed of four legs welded or otherwise secured to and about a centrally positioned tubular ring is secured to a tabletop via screws. However, such a base supports the tabletop top in a wobbly manner. This presents an annoying condition for eating purposes, for use of the tabletop as a surface to permit writing of letters, etc. and an overall unstable condition.

Accordingly, it is an object of this invention to provide a table of knock-down construction which can be readily assembled.

It is another object of the invention to provide an outdoor umbrella table of aesthetic appearance.

It is another object of the invention to provide an outdoor table of knock-down construction which is stable in assembled condition.

It is another object of the invention to be able to manufacture, transport and store an outdoor table in an economical manner.

Briefly, the invention provides a table which is comprised of a base and a tabletop mounted on the base. The base is provided with a plurality of depending legs and a plurality of outwardly directed supports which are disposed in a common horizontal plane. In addition, the tabletop includes a peripheral rim which defines a depending lip about the supports as well as means on the lip for releasably engaging with the supports to releasably lock the tabletop to the base.

The base is constructed so that a pair of leg frames can be disposed in interfitted crossing relation to each other with each leg frame including a central hub and a pair of leg-forming members. Each of these leg-forming members extends from an opposite side of the hub and has a depending leg and an outwardly directed support.

The supports of the leg-forming members each define a flat bar shape for supporting the tabletop thereon while the means for releasably engaging the supports are constituted by a plurality of brackets, each of which has a horizontal leg engaging under a respective support with a vertical wall abutting the support. In addition, the brackets are disposed in pairs with the bracket legs of each pair in facing relation to each other.

In order to rigidify the base, each leg-forming member has a vertical strut extending between a leg and a support.

The tabletop can be constructed with a transparent flat disc-like plastic member which is fixedly mounted in the rim. As such, the tabletop can be used for various outdoor uses such as for eating purposes. In addition, the tabletop can be provided with a central aperture while the hubs of the base are also of hollow construction so as to guide and support an umbrella shaft therein.

The construction of the table is such that each leg frame can be constructed as a unitary body, for example, with the leg-forming members welded to a hub of rectangular cross-sectional shape. A pair of such leg frames can be shipped along with the tabletop in a flat configuration. For assembly, the leg frames are simply interfitted one within the other with the hubs coaxially aligned in a vertical plane. Thereafter, the tabletop is rested on the horizontal supports of the leg frames and rotated slightly to fit two of the brackets under the supports. Next, the remaining two legs are moved slightly about the remaining two brackets and then slid into place to complete the releasable locking of the tabletop to the base.

When assembled, the tabletop is rigidly held to the base. Further, with the leg frames assembled in crossing relation to each other, a slight bias is imparted to the supports to prevent accidental sliding of the supports out of the brackets.

These and other objects and advantages of the invention will become more apparent from the following detailed description taken in conjunct with the accompanying drawings wherein:

FIG. 1 illustrates a perspective view of an outdoor table constructed in accordance with the invention;

FIG. 6 illustrates an enlarged detail view of a means for releasably engaging with a support of the table base in accordance with the invention;

FIG. 7 illustrates a view taken on line 7—7 of FIG. 1; and

FIG. 8 illustrates a view taken on line 8—8 of FIG. 1.

Referring to FIG. 1, the table 10 is constructed for use as an outdoor table, for example, for use as an umbrella table. The table 10 includes a base 11 and a tabletop 12 which is mounted on the base 11.

Figure 2:
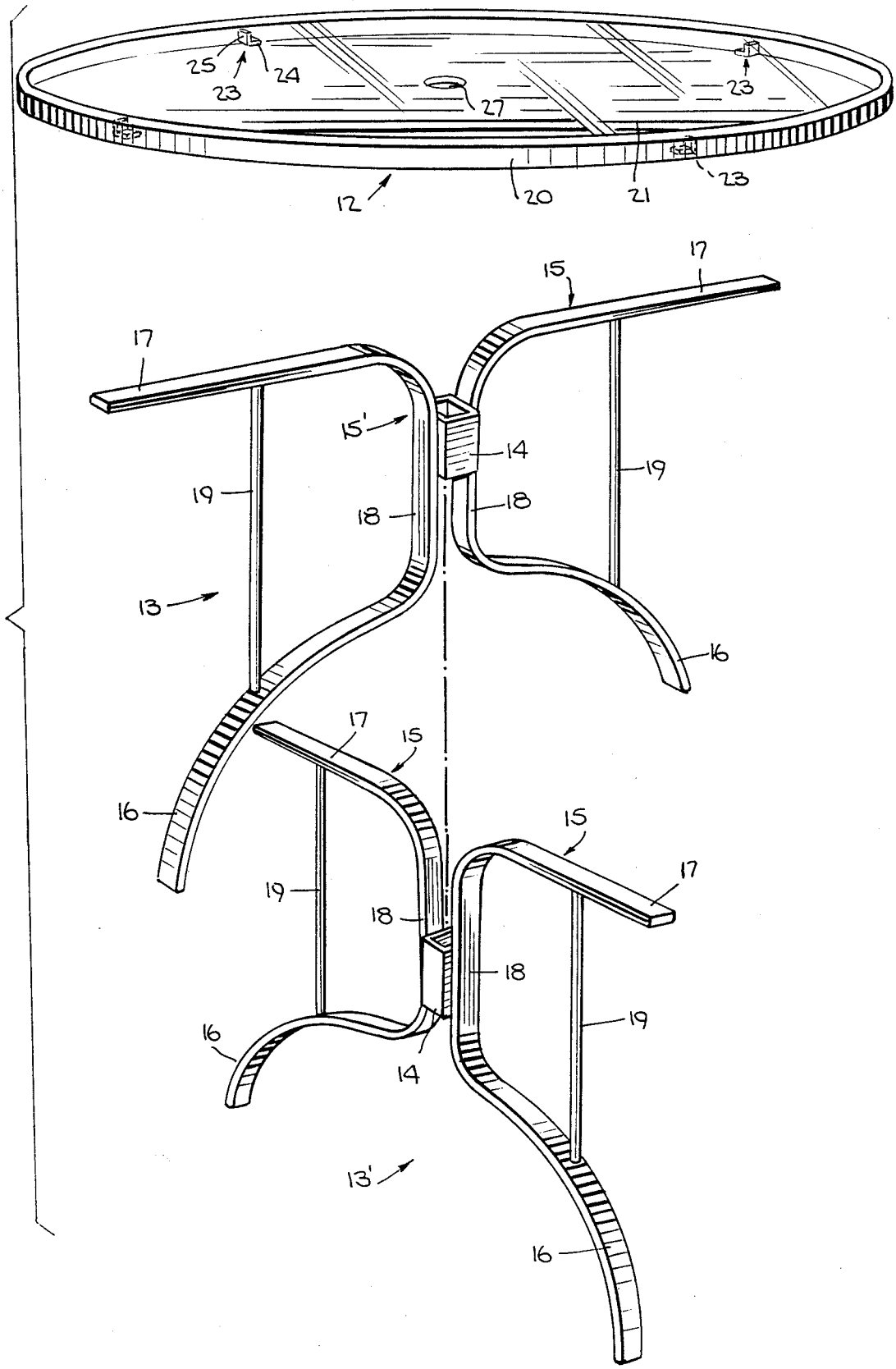
FIG. 2 illustrates an exploded view of the table of FIG. 1.

Referring to FIGS. 1 and 2, the base 11 is formed of a pair of leg frames 13, 13' which are disposed in interfitted crossing relation to each other. Each leg frame 13, 13' includes a central hub 14 and a pair of leg-forming members 15 which are secured on opposite sides of the hub 14 as by welding. As shown in FIG. 8, each hub 14 is of hollow construction and is provided with a square cross-sectional shape. In addition, each leg-forming member 15 is of generally U-shape so as to define a depending leg 16 and an outwardly directed support 17 and an intermediate vertical section 18. Further, each leg-forming member 15 is made of flat bar shape which is bent or otherwise formed into the shape illustrated in FIG. 2. Alternatively, the leg-forming members 15 may be made of other cross-sectional shapes such as a double tube or other shape where the members are more rigid in one direction than a transverse direction.

As shown in FIG. 2, each leg-forming member 15 has a strut 19 extending between each leg 16 and a co-planar support 17 in order to stiffen the leg-forming member 15.

As indicated in FIG. 2, the hub 14 of one leg frame 13 is located in a higher horizontal position than the hub 14 of the other leg frame 13' so as to permit the two leg frames to fit one within the other with the hubs 14 coaxially aligned.

The leg frames 13, 13' may be formed of any suitable material, such as aluminum, and may be painted, for example, with a powder-coated enamel to enhance appearance and to resist corrosion.

Referring to FIGS. 1 and 2, the tabletop 12 includes a peripheral rim 20 which defines a peripheral lip which extends circumferentially about the supports 17 of the base 11. As indicated in FIG. 7, the rim 20 is of substantially rectangular shape and extends above and below the plane of the supports 17. This rim 20 may also be made, for example, of aluminum in hollow tube form, and may also be powder-coated for aesthetic and anti-corrosion purposes The tabletop 12 also includes a flat disc-like plastic member, for example, a transparent plastic member 21, which is fixably mounted in the rim 20. As indicated in FIGS. 6 and 7, the hollow rim is provided with an inwardly directed annular groove 22 to receive the peripheral edge of the plastic member 21. Any suitable technique may be used to mount the plastic member 21 in place within the groove 22, for example by using a split rim 20 which can be wrapped about the member 21 and fastened at a joint at the abutting ends of the rim 20.

The tabletop 12 also has means on the lip 20 for releasably engaging with the supports 17 in order to releasably lock the tabletop 12 to the base 11. As shown in FIGS. 1 and 2, this means is in the form of a plurality of circumferentially spaced apart brackets 23, which are secured to the inside of the rim 20. Each bracket 23 is of L shape with a horizontal leg 24 engaging under a support 17 and an upstanding vertical wall 25 abutting against a respective support 17. As indicated in FIG. 2, the brackets 23 are disposed in pairs with the bracket legs 24 of each pair in facing relation to each other.

The table 10 can be transported and/or stored in a knock-down fashion. To this end, the leg frames 13, 13' can be laid flat, one against the other, with the tabletop 12 laid against the leg frames 13, 13'. In such a condition, a table having a diameter of 42 inches and a height of 27 inches can be shipped in a carton of limited dimensions, for example of a thickness of less than 5 inches and a width and height of about 50 inches each.

Figure 3:
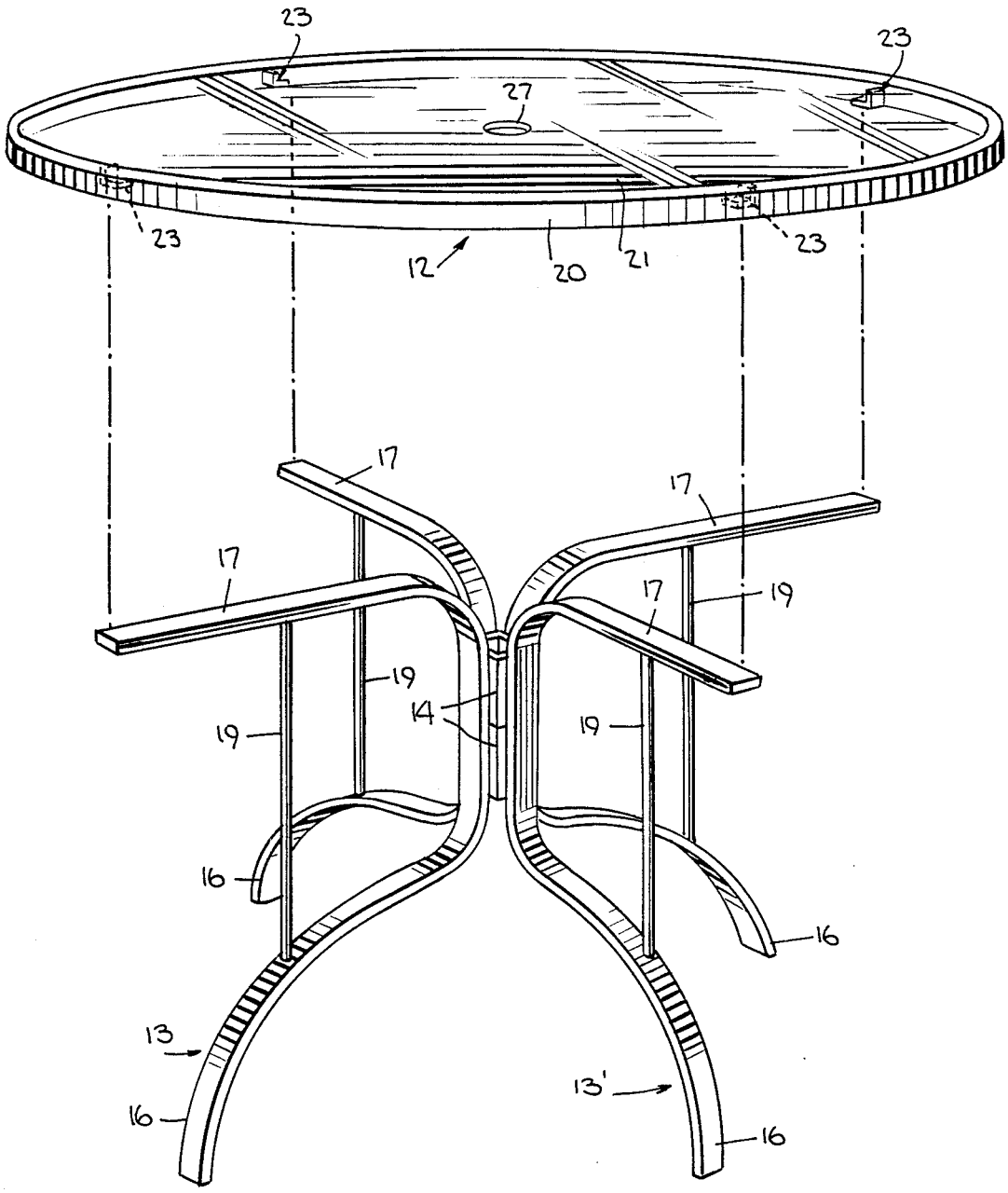
FIG. 3 illustrates a partially exploded view of the table of FIG. 1 with the leg frames assembled.

In order to assemble the table 10, the leg frames 13, 13' are interfitted in crossing relation to each other, as indicated in FIG. 2 so that the hubs 14 are coaxially aligned and rest one on the other as indicated in FIG. 3. In this condition, the leg frames provide a stable base with the legs 16 disposed in uniformly spaced manner and with the supports 17 radiating outwardly of a vertical axis defined by the hubs 14.

Next, the tabletop 12 is placed on the flat supports 17 as indicated in FIG. 3 and slightly rotated to bring a pair of diametrically extending supports 17 into abutment with the vertical walls 25 of the adjacent brackets 23 and over a respective leg 24, for example as indicated in FIGS. 6 and 7.

Thereafter, the remaining pair of diametrically extending supports 17 can be moved under the brackets 23 and slid into place one at a time. The resulting connection is such that the tabletop 12 is releasably locked to the base 11.

Figure 4:
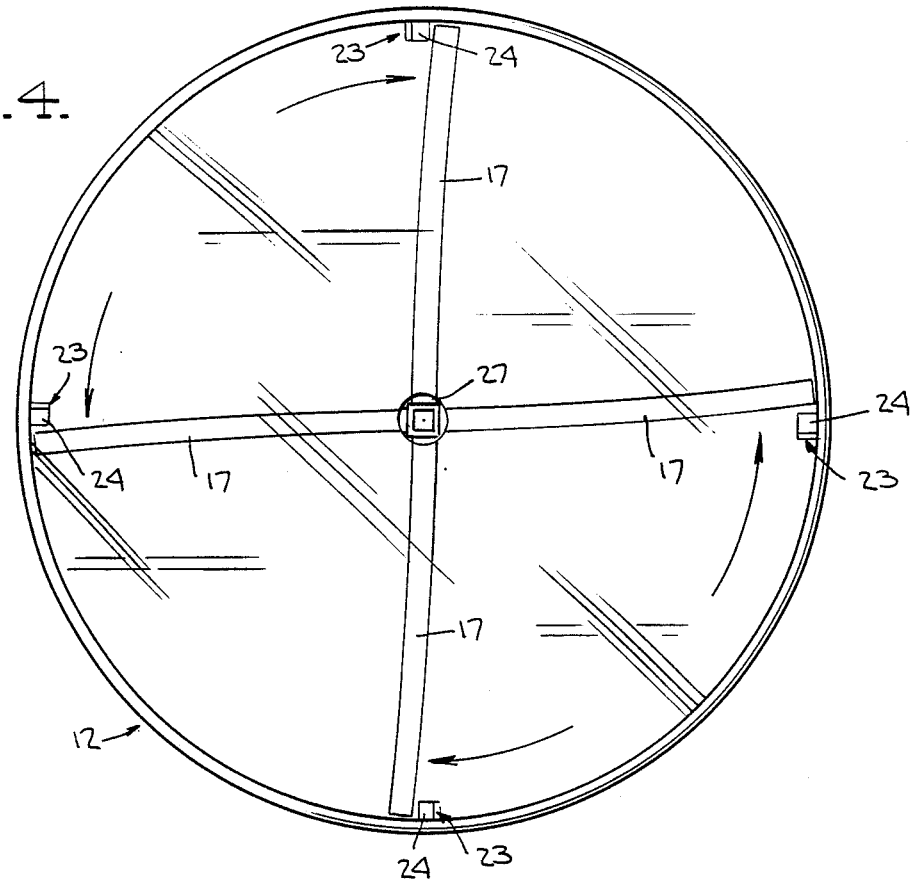
FIG. 4 illustrates a top view of the table during an initial phase of mounting the tabletop on the base.
Figure 5:
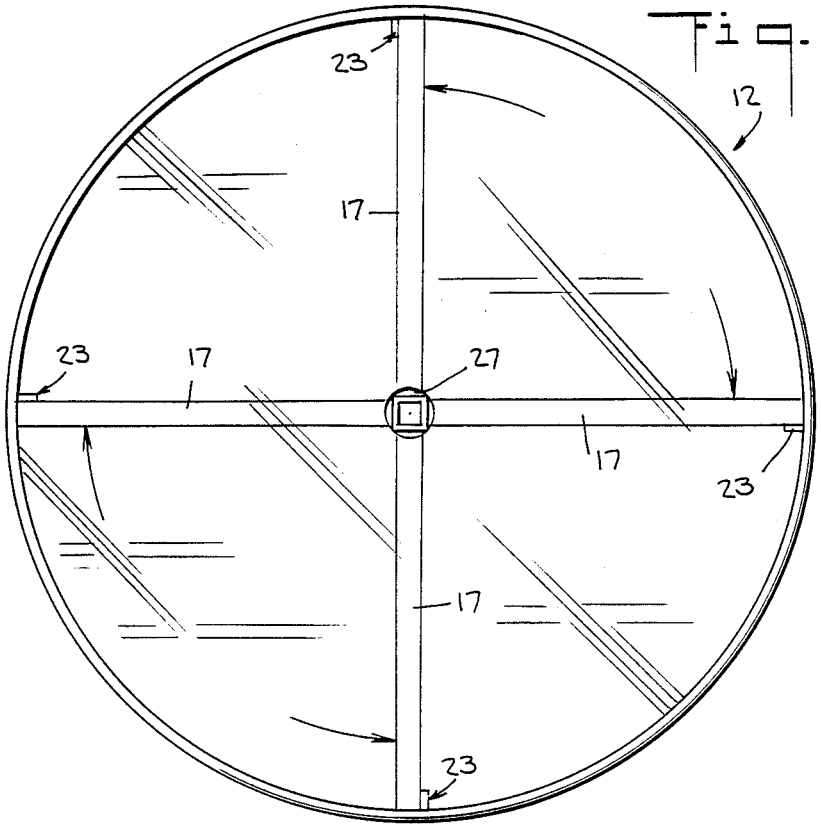
FIG. 5 illustrates a top view of the table during a second phase of securing the tabletop to the base in accordance with the invention.

Because the brackets 23 are disposed in opposing relation in the respective pairs, the risk of an accidental turning of the tabletop 12 on the base 11 is eliminated. In this regard, as indicated in FIG. 4, the tabletop 12 cannot rotate relative to the base 11 once in place. This is, one pair of brackets prevents rotation in a clockwise direction, as viewed, while the other pair of brackets 23 prevents rotation in a counterclockwise direction, as viewed.

In order to disassemble the table 10, one support 17 can be forced away from one bracket 23 and moved under and to the other side of the bracket 23. Next, the diametrically opposed support 17 can be moved in a similar manner. Thereafter, the table can be simply rotated to remove the remaining two supports 17 from engagement with the brackets 23. The tabletop 12 can then be lifted off the base 11 and moved to one side.

Thereafter, the leg frames 13, 13' are separated and placed in side-by-side relationship next to the tabletop 11 for subsequent storage.

The base 11 of the table 10 is relatively stable due, in part, to the square shape of the hubs 14 which interfit in each other. In addition, the leg-forming members 15 are rigidly secured to a respective hub 14, for example, by pairs of welds 26 along the sides of the vertical section 18 of each member 15, as shown in FIG. 8. This securement of the vertical section 18 along two spaced apart vertical lines adds to the rigidity of the base 11 while further resisting twisting of the leg-forming members 15 relative to the hub 14.

Since the supports 17 are horizontally disposed, the tabletop 12 is supported on a relatively large surface area, i.e. directly on the upper surfaces of the four supports 16.

In the case of large tabletops, for example, of a diameter of 42 inches, the reach provided by the supports 17 from the central vertical axis of the table 10 can be quite substantial. This facilitates the flexing of the ends of the supports 17 about the brackets 23 when the tabletop 12 is being mounted on the base 11.

As shown in FIG. 1, the tabletop 12 is provided with a central aperture 27, which is aligned coaxially with the hubs 14. This aperture 27 is sized to permit passage of a shaft of an umbrella (not shown) so as to permit use of the table 10 as an umbrella table.

The invention thus provides an outdoor table of relatively rigid construction. Further, the invention provides an outdoor table of knock-down construction which can be readily assembled and disassembled without the need for tools.

The invention further provides an outdoor table of pleasing aesthetic appearance.

When assembled, the table presents a stable construction since the legs are splayed outwardly from the central and vertical axis and provide a relatively wide footing to the table. Further, the table is supported on four separate radially disposed surfaces and is releasably locked at four equally spaced apart circumferential points.

What is claimed is:

1. A table comprising a base having a plurality of depending legs, a plurality of outwardly directed supports disposed in a common horizontal plane, a plurality of intermediate sections connecting said legs and supports and a plurality of vertical struts, each said strut extending between a respective leg and a respective support to stiffen said support; and a tabletop mounted on said base, said tabletop including a peripheral rim defining a depending lip about said supports and means on said lip for releasably engaging with said supports to releasably lock said tabletop to said base, said means including a plurality of L-shaped brackets secured to said lip, each said bracket having a horizontal leg engaging under a respective support and a vertical wall abutting said respective support with each support being movable away from said vertical wall during release of said support from said tabletop.

2. A table as set forth in claim 1 wherein said brackets are disposed in pairs with said bracket legs of each said pair in facing relation to each other.

3. A table comprising a base having a pair of leg frames disposed in interfitted crossing relation to each other, each said leg frame including a central hub of square cross-sectional shape disposed in vertical relation to a hub of the other leg frame and a pair of leg-forming members, each said member having an intermediate section rigidly secured along two sides thereof to a respective hub, a depending leg and an outwardly directed horizontally disposed support; and a tabletop mounted on said base and supported on said supports, said tabletop including a peripheral rim defining a depending lip about said supports and means on said lip for releasably engaging with said supports to releasably lock said tabletop to said base.

4. A table as set forth in claim 3 wherein said leg-forming member includes a strut between said leg and said support thereof to stiffen said member.

5. A table as set forth in claim 3 wherein each hub is hollow and said tabletop includes an aperture coaxial with said hubs for passage of an umbrella shaft therethrough.

6. A table as set forth in claim 3 wherein said means includes a plurality of brackets secured to said lip, each said bracket having a horizontal leg engaging under a respective support and a vertical wall abutting said respective support.

7. A table as set forth in claim 6 wherein said brackets are disposed in pairs with said bracket legs of each said pair in facing relation to each other.

8. A table as set forth in claim 6 wherein said brackets are disposed in diametrically opposite pairs.

9. A table as set forth in claim 3 wherein said tabletop includes a flat disc-like plastic member fixedly mounted in said rim.

10. An outdoor table as set forth in claim 9 wherein said plastic member is transparent.

11. An outdoor table as set forth in claim 3 wherein each support defines a flat bar shape for supporting said tabletop thereon.

12. A table comprising a base having a pair of leg frames disposed in interfitted crossing relation to each other, each leg frame including a central hub of square cross-section disposed in vertical coaxial relation to a hub of the other leg frame and a pair of leg-forming members, each said member being of flat bar shape including an intermediate member rigidly secured to a respective hub, a depending leg, a horizontally disposed outwardly directed support and a strut between said leg and said support;

a tabletop mounted on said supports of said base and having a rim defining a depending lip about said supports and brackets on said lip for releasably engaging with said supports to releasably lock said tabletop to said base, each said bracket being of L-shape with a horizontal leg engaging under a respective support.

13. A table as set forth in claim 12 wherein said brackets are disposed in pairs with said horizontal legs of each said pair in facing relation to each other.

14. A table comprising a base having a plurality of depending legs, a plurality of outwardly directed supports disposed in a common horizontal plane, a plurality of intermediate sections connecting said legs and said supports, and a plurality of vertical struts, each said strut extending between a respective leg and a respective support to stiffen said support; and a tabletop mounted on said base, said tabletop including a peripheral rim defining a depending lip about said supports and means on said lip for releasably engaging with said supports to releasably lock said tabletop to said base.

15. A table as set forth in claim 14 wherein each support defines a flat bar shape for supporting said tabletop thereon.

16. A table as set forth in claim 14 which further comprises a plurality of coaxial hubs, each said hub being secured to and between a respective pair of oppositely disposed intermediate sections.

17. A table as set forth in claim 16 wherein each said hub is of square cross-sectional shape.

* * * * *